United States Patent [19]

Sambursky

[11] Patent Number: 4,673,776

[45] Date of Patent: Jun. 16, 1987

[54] LOCKING SWITCH FOR AUTOMOBILE ELECTRICAL SYSTEMS AND THE LIKE

[75] Inventor: Michael H. Sambursky, Independence, Mo.

[73] Assignee: K & S Systems, Inc., Kansas City, Mo.

[21] Appl. No.: 800,660

[22] Filed: Nov. 22, 1985

[51] Int. Cl.[4] ..... H01H 27/06

[52] U.S. Cl. ..... 200/43.08; 200/155 A; 200/277

[58] Field of Search ..... 200/43.08, 277, 291, 200/155 A, 284

[56] References Cited

U.S. PATENT DOCUMENTS

| | | | |
|---|---|---|---|
| 1,410,855 | 3/1922 | Veneria | 200/63 R |
| 1,624,374 | 4/1927 | Swobada | 200/11 E |
| 1,651,314 | 11/1927 | Beasley, Jr. | 200/277 |
| 1,886,517 | 11/1932 | Batcheller | 200/154 |
| 2,201,881 | 5/1940 | Bryant et al. | 200/8 R |
| 2,662,131 | 12/1953 | Cerna et al. | 200/43.08 |
| 2,926,229 | 2/1960 | Brown et al. | 200/277 |
| 3,218,401 | 11/1965 | Root | 200/43.08 |
| 3,453,591 | 7/1969 | Perez | 340/64 |
| 3,525,414 | 8/1970 | Copelan | 180/289 |
| 3,603,750 | 9/1971 | Beker | 200/43.08 |
| 3,649,782 | 3/1972 | Feldman | 200/43.08 |
| 3,821,501 | 6/1974 | Parmenter | 200/155 R |
| 4,031,345 | 6/1977 | Garcia | 200/67 AA |
| 4,063,610 | 12/1977 | Shilling | 307/10 AT |
| 4,149,609 | 4/1979 | Flate, Jr. | 180/287 |
| 4,278,963 | 7/1981 | Allen | 340/64 |
| 4,292,541 | 9/1981 | Ambrosius | 307/10 AT |
| 4,424,424 | 1/1984 | Hollenbeck, Jr. | 200/43.08 |
| 4,438,426 | 3/1984 | Adkins | 340/64 |
| 4,452,197 | 6/1984 | Weber | 123/198 B |

FOREIGN PATENT DOCUMENTS

| | | | |
|---|---|---|---|
| 425119 | 2/1926 | Fed. Rep. of Germany | 200/155 A |

*Primary Examiner*—Stephen Marcus
*Assistant Examiner*—Renee S. Luebke
*Attorney, Agent, or Firm*—Litman, Day & McMahon

[57] ABSTRACT

A locking switch for electrical automobile systems connects and disconnects an automobile battery to the starter. The locking switch has two normally separated contact plates, one connected to a cable from the battery and the other being connected to a cable from the starter. A lock cam is mounted at the end of a cylinder lock, which is key-actuated. The lock cam carries a spring-loaded copper ball that rotates with the lock cam upon actuation by the key. The cam and ball can be moved from an open position on one stationary contact to a closed position, whereby the ball provides electrical contact between the two stationary contacts, thus completing the electrical circuit between the battery and the starter. Each stationary contact is provided with a semispherical indentation in which the ball is received in the open position, thereby providing a substantial contact area between the ball and each of the two stationary contacts. The stationary contacts are received in a circuit insulator, which positions and spaces them from one another. A divider portion of the circuit insulator is notched for receipt of the copper ball in the operative position, such that the divider portion together with the indentations in the two stationary contacts form a substantially continuous semispherical indentation for receipt of the copper ball.

2 Claims, 5 Drawing Figures

LOCKING SWITCH FOR AUTOMOBILE ELECTRICAL SYSTEMS AND THE LIKE

BACKGROUND OF THE INVENTION

This invention relates to locking switches for use in electrical systems, and particularly for such locking switches used in an automobile electrical system between a battery and an electric starter.

Automobiles are especially prone to theft, partially due to the ease with which the ignition switch can be circumvented, as by a procedure known as "jumping" the ignition. In this procedure, the input lead to the ignition switch is connected to the output lead from same by use of jumper wire having alligator clips on each end, thereby completing the electrical circuit between the battery and the starter. Attempts to protect the ignition switch by means of armoured tubing have not been successful against the more sophisticated auto thief. One solution to this problem has been to provide a secondary locking switch between the battery and the electric starter. However, such devices have been found to be lacking in a variety of ways, including use of poor means of opening, or deenergizing, the system, inadequate contact areas, and inadequate protection of the locking switch itself. Additionally, many such locking switches do not adequately protect the electrical contacts to inhibit "jumping" of the switch.

OBJECTS OF THE INVENTION

The principal objects of the present invention are: to provide a locking switch for an automobile electrical system; to provide such a switch which is situated in line between a car battery and an electric starter; to provide such a switch which has cam means for selectively closing and opening the electrical circuit switch; to provide such a switch which includes cam means having a spring-loaded ball for providing electrical contact between two stationary contacts or stators; to provide such stators having indentations for receiving the copper ball and engaging said ball over a significant section of the outer surface thereof; to provide such a switch which can accommodate the heavy electrical load encountered in a battery cable running to the starter; to provide such a switch which shields and conceals contact terminal studs to inhibit access thereto; and to provide such a switch which is relatively simple to use, economical to manufacture, and particularly well adapted for the proposed usage therof.

Other objects and advantages of this invention will become apparent from the following description taken in conjunction with the accompanying drawings wherein are set forth, by way of illustration and example, certain embodiments of this invention.

SUMMARY OF THE INVENTION

The present invention is directed to a locking switch for electrical vehicle systems, including those in automobiles, trucks, boats, planes, and the like. The switch is adapted to connect and disconnect an automobile battery to the starter of the automobile. The locking switch has two normally separated stationary contact plates or stators, one having an integral terminal stud connected to a cable from the battery and the other also having an integral terminal stud connected to a cable from the starter. A lock cam is mounted at the end of a cylinder lock, which is key-actuated. The lock cam carries a spring-loaded copper ball that rotates with the lock cam upon actuation by the key. The cam and ball can be moved from an open position on one stator to a closed position whereby the ball provides electrical contact between the two stators, thus completing the electrical circuit between the battery and the starter. Each stator is provided with a semispherical indentation in which the ball is received in the closed, energized, position, thereby providing a substantial contact area between the ball and each of the two stators. The stators are received in a circuit insulator, which positions and spaces them from one another. A divider section of the circuit insulator is notched for receipt of the copper ball in the operative position, such that the divider section together with the indentations in the two stators form a substantially continuous semispherical indentation for receipt of the copper ball.

The drawings constitute a part of this specification and include exemplary embodiments of the present invention and illustrate various objects and features thereof.

DETAILED DESCRIPTION OF THE INVENTION

Figures 1, 2, 3, 4, 5:
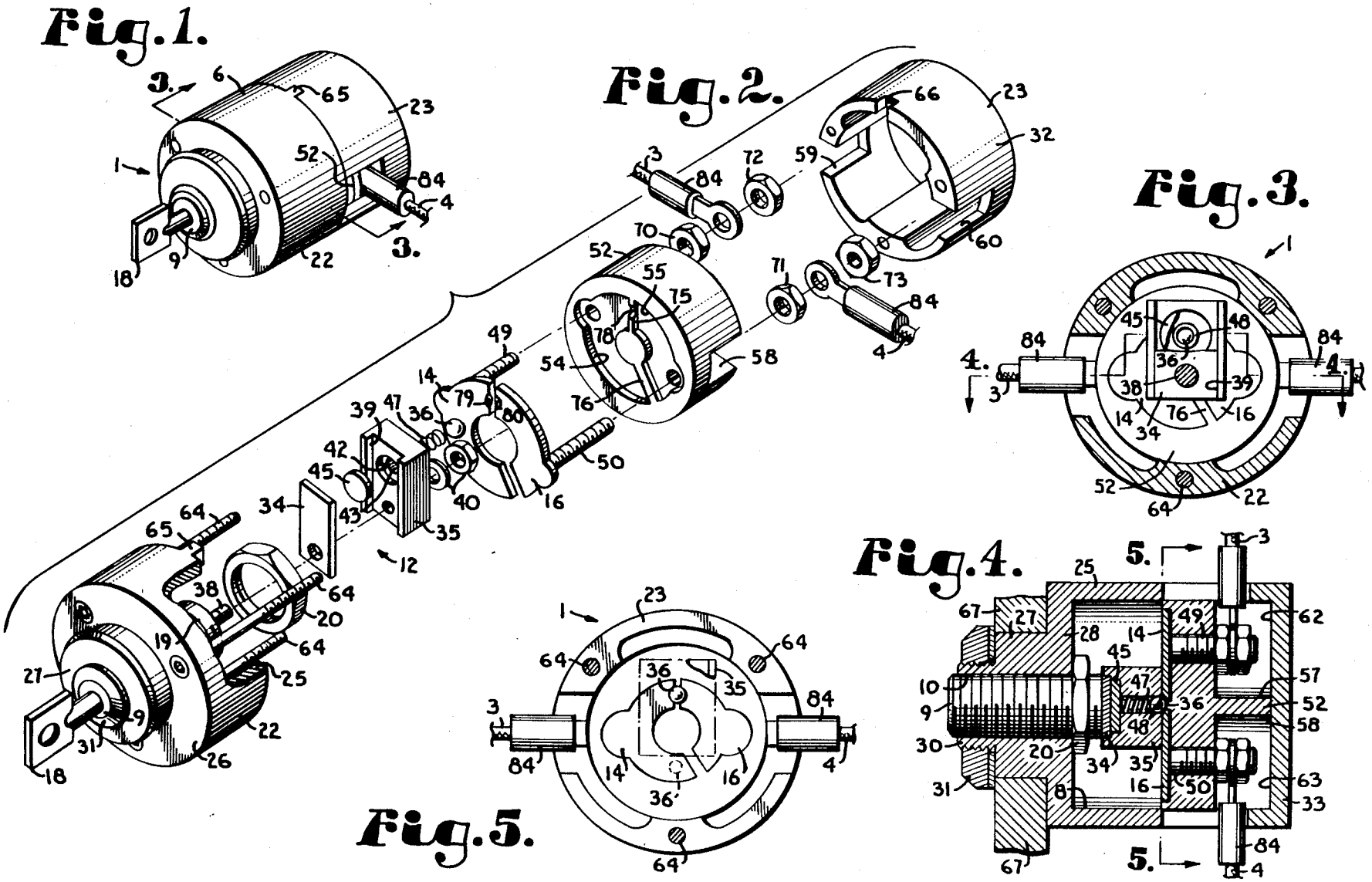
FIG. 1 is a perspective view of the locking switch embodying the present invention and showing an electrical cable adapted to extend to an electric starter.
FIG. 2 is an enlarged, exploded view of the switch shown in FIG. 1.
FIG. 3 is an enlarged, fragmentary cross-sectional view of the locking switch taken along line 3—3, FIG. 1.
FIG. 4 is an enlarged, fragmentary cross-sectional view of the locking switch taken along line 4—4, FIG. 3.
FIG. 5 is an enlarged, fragmentary cross-sectional view of the locking switch taken along line 5—5, FIG. 4.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates a locking switch for an automobile electrical system and the like. The locking switch 1 includes means for connection to an electrical circuit, such as to a battery cable lead 3 and an electric starter cable lead 4. The battery, or primary, lead 3 and starting motor, or secondary, lead 4 are in turn connected to a battery (not shown) and starter motor (not shown), respectively, although it is envisioned that the locking switch 1 could be situated in other electrical lines of the automobile system.

The locking switch 1 includes an aluminum case 6 having an interior chamber 8 for receiving the other components of the locking switch 1, including lock means. The lock means include a cylinder lock 9, which is received through an aperture 10 in the case 6. The cylinder lock 9 is connected to a cam means 12, which in turn contacts a primary stationary contact plate or stator 14, and provides for angular movement of contact means about a central axis of the cylinder lock 9. In an operation described below, the cam means also selectively contacts a secondary stationary contact plate or stator 16 to close the electrical circuit.

A key 18 is provided for actuating the cylinder lock 9, which lock 9 includes a tumbler 19, which is held in place by means of a hex nut 20. Rotation of the lock 9 is inhibited by means of the tumbler 19 having a flat side which interferes with a flat side of the case wall that defines the aperture 10. This configuration is well known in the art.

The case 6 includes a lock casing section 22 and an insulator casing section 23, as seen in FIG. 2. When together, the lock and insulator casing sections 22 and 23 define the case chamber 8 and form a protective shield around the remainder of the switch 1. The lock casing section has an outer circular wall 25, a shoulder area 26, and a projecting neck segment 27.

The lock casing section 22 also includes an end wall 28 in the chamber 8, as shown in FIG. 4. In order to retain the cylinder lock 9 in place, the hex nut 20 abuts against the end wall 28. An outer section 30 of the neck 27 is threaded to receive a collar 31, which is used to securely retain the locking switch in a mounted position.

The cam means 12 includes a stop plate 34, a camming body 35, and contact means, such as a spring-loaded ball 36. As seen in FIGS. 2 and 3, the stop plate 34 and camming body 35 have respective apertures through which a threaded extension 38 of the cylinder lock 9 extends. The stop plate 34 is received in a channel 39 of the camming body 35 and, when both are received onto the threaded section 38, a nut and washer unit 40 retain same in a fixed position relative to the cylinder lock 9. Thus, when the lock tumbler 19 rotates, upon actuation by the key 18, the stop plate 34 and camming body 35 rotate appropriately. It is noted that the nut and washer unit 40 is received into a recess (not shown) in the backside of the camming body 35.

An eccentric recess 42 and bore 43 are defined in the camming body 35 and are spaced from a central axis of the cylinder lock 9, which axis extends through the stop plate and camming body apertures discussed above. An insulator plug 45 is received in the recess 42 and is retained in position by the stop plate 34.

It is noted that the camming body 35 and insulator plug 45 are preferably coated with an insulative material, such as a tetrafluoroethylene fluorocarbon polymer, one example of which is marketed under the trademark TEFLON by E. I. Du Pont de Nemours & Co.

A spring 47 is received in the bore 43, as is the ball 36. The spring 47 tends to bias the ball 36 toward the back side of the camming body 35. As seen in FIG. 4, the camming body is formed so as to narrow the diameter of the bore 43 to form a shoulder 48 toward the side of the camming body 35 opposed from the channel 39. The camming body 35 narrows the bore 43 at the shoulder 48 sufficiently to provide means for retaining the ball 36 within the bore 43 while at the same time allowing it to project therefrom about a significant portion of its outer surface, as seen in FIG. 4.

The primary stator 14 and secondary stator 16 are generally ring-like in shape, and as seen in FIG. 2, each has a respective terminal stud 49, 50. The terminal studs 49, 50 project away from the flat, plate-like stators and are adapted to be connected to their respective cable leads 3, 4.

A circuit insulator 52 is fabricated to fit within the chamber 8 and is formed with a primary cavity 54 and secondary cavity 55 for receipt of the primary stator 14 and secondary stator 16. The circuit insulator 52 is coated with an insulative material, such as the TEFLON material referred to above. Each of the primary and secondary cavities 54, 55 has an aperture therethrough, through which respective primary and secondary terminal studs 49, 50 extend.

As seen in FIG. 1, the circuit insulator 52 has circumferentially opposed primary and secondary notches 57, 58 which cooperate with respective primary and secondary notches 59, 60 in the insulator casing section 23. When the locking switch 1 is assembled, the respective primary notches 57 and 59 and secondary notches 58 and 60 cooperate to form primary and secondary terminal chambers 62 and 63 into which the respective cable leads 3, 4 extend.

To assemble the locking switch 1, the lock casing section 22 and insulator casing section 23 are provided with a plurality of threaded bores which receive screws 64 for fastening the two casing sections 22, 23 together as a rigid unit. A detent 65 on the lock casing section 22 cooperates with a notch 66 for a proper alignment of the two casing sections 22, 23. However, prior to the screw fastening, the cylinder lock 9 is inserted through the aperture 10 and fixed relative thereto by means of the hex nut 20.

The collar 31 is screwed onto the outer neck section 30 and can be used for mounting the locking switch 1 to a wall 67 or the like of the automobile. The ball 36 and spring 47 are placed in the bore 43 and the insulator plug 45 is placed in the recess 42, at which point the stop plate 34 is placed in the channel to hold these pieces in place. The assemblage of the camming body 35 and associated parts is then fastened to the cylinder lock 9 by means of the nut and washer unit 40 being screwed onto the threaded extension 38 after the extension is passed through the apertures in the stop plate 34 and camming body 35.

The primary stator 14 is placed in the primary cavity 54 of the circuit insulator 52 and the secondary stator 16 is placed in the secondary cavity 55 of the circuit insulator 52, with the respective terminal studs 49 and 50 extending through the circuit insulator 52. The primary and secondary stators 14, 16 are fixed in place by means of respective nuts 70, 71, which abut against the rearward side of the circuit insulator 52. Means are provided for securing the cable leads to the locking switch. As illustrated, the respective cable leads 3, 4 are received onto the primary and secondary terminal studs 49, 50 and held fast thereon by respective nuts 72, 73.

This assemblage of the circuit insulator 52, primary and secondary stators 14, 16 and cable leads 3, 4 is then placed within the insulator casing section 23 which is then fastened by the plurality of screws to the lock casing section 22.

As seen in FIG. 2, the circuit insulator 52 is formed to have divider portions, such as spacer walls 75, 76 between the primary and secondary stators 14, 16. The primary stator 14 is larger than the secondary stator 16 for purposes described below.

One spacer wall 75 has a semicircular indentation 78 therein. The primary stator 14 has a semispherical indentation 79 therein, which is adjacent the spacer wall indentation 78 when the locking switch 1 is assembled. Correspondingly, the secondary stator 16 has a semispherical indentation 80 therein, which is also adjacent the spacer wall indentation wall 78 when in the assembled position, but is on the opposite side thereof from the primary stator indentation 79. Taken together, these indentations 78, 79, and 80 cooperate to form a generally hemispherical semispherical indentation sized to receive the ball 36, as seen in FIG. 4. When the ball 36 is in the indentation, the circuit is completed between the cable leads 3 and 4, thus allowing electricity to flow therethrough.

The camming body 35 rotates with the lock tumbler 19, consequently rotating the ball 36 in a circular arc around the axis of the lock 9, whereupon the ball 36 is substantially compressed into the bore 43 and contacts only the primary stator 14, to open the circuit.

The battery cable lead 3 and electric starting motor cable lead 4 both have a cable insulator 84 therearound, as seen in FIG. 2. The cable insulators 84 are coated with an insulative material, preferably the TEFLON material, and surround the battery cable lead 3 and electric starting motor cable lead 4. The cable leads 3, 4 are both insulated and protected by the cable insulators 84.

The components that are intended to be used to complete the electrical circuit, namely the primary and secondary stators 14, 16, their associated terminals studs 49, 50, and ball 36, are preferably made from a highly conductive material, such as copper or the like. The other components in the system that come in contact with these copper components, namely the camming body 35, insulator plug 45, circuit insulator 52 and the cable insulators 84, are all coated with an insulative material, such as the TEFLON material. Thus, the system is isolated, which reduces the possibility of inadvertent electrical shock to a user.

In use, the locking switch 1 selectively closes or opens the electrical circuit to which it is connected. As illustrated, it is adapted to be connected to an automobile electrical system when placed in line between a battery and an electric starter and attached thereto by respective cable leads 3, 4. Referring to FIG. 5, when the lock tumbler 19 is rotated, by means of the key 18, to the closed, or energized position, the ball 36 is resting in the semispherical indentation formed by the various indentations 78, 79, and 80 in the primary stator 14, spacer wall 75, and secondary stator 16. Since the primary stator and integral stud 49, ball 36, and primary stator 16 and associated stud 50 are made from copper, they are electrically conductive such that the electricity can flow from the battery cable lead 3 to the starter cable lead 4. The indentation 78, 79 and 80 form the semispherical indentation and contact a substantial section of the outer surface of the ball 36 to ensure adequate contact between the two stators 14 and 16.

As illustrated, the lock tumbler 19 is adapted to rotate counterclockwise to an open position, indicated by means of showing the ball 36 in phantom in FIG. 5. The primary stator 14 is shown to be somewhat larger than the secondary stator 16, to allow for a 180° rotation of the lcok tumbler 19 to an open position. As the lock tumbler 19 is rotated counterclockwise, the ball contacts the primary stator 14 and is pushed further into the bore 43, compressing the spring 47. As soon as the ball 36 is out of contact with the secondary stator indentation 80, the circuit is open, or deenergized, such that no electricity can flow from the battery cable lead 3 to the electric starting motor cable lead 4. The 180° rotation is utilized because many cylinder locks 9 are designed to allow removal of the key only in positions diametrically opposed from each other.

It is to be understood that while certain forms of the present invention have been illustrated and described herein, it is not to be limited to the specific forms or arrangement of parts described and shown.

What is claimed and desired to be secured by Letters Patent is as follows:

1. A locking switch, which comprises:

(a) a casing including a lock casing section with an interior chamber and an insulator casing section releasably fastened together, said insulator casing section including a bore terminating at a closed end and a pair of lead openings communicating with said bore;

(b) a cylinder lock connected to said lock casing section and projecting into said interior chamber thereof, said lock having a tumbler rotatable about a central axis of said lock;

(c) said tumbler having a range of rotational movement of substantially 180° between open and closed positions;

(d) a lock cam connected to said tumbler within said lock casing section chamber and rotatable about the central axis of said lock, said lock cam including:

(1) a camming body attached to said lock, said camming body including an eccentrically placed bore through said camming body in parallel, spaced relationship relative to the central axis of said lock, said camming body bore having a proximate end and a restricted distal end;

(2) a spring received in said camming body bore;

(3) an insulator plug placed over said proximate end of said bore and engaging said spring; and (4) a conductor ball received in said camming body bore and engaged by said spring, said conductor ball having a greater diameter than said camming body bore restricted distal end whereby most of said conductor ball is within said camming body bore and said conductor ball projects outwardly from said camming body;

(e) a circuit insulator received in said insulator casing section and including:

(1) an outer end located in proximity to said lock cam;

(2) an inner end abutting said insulator casing section closed end;

(3) a pair of terminal notches at said inner end;

(4) primary and secondary stud receivers each extending longitudinally through said circuit insulator between said outer end and a respective notch, each said stud receiver extending in parallel, spaced relation with respect to said cylinder lock central axis;

(f) an electrically conductive primary-stator including:

(1) a substantially planar outer surface and an inner surface adjacent said circuit insulator outer end;

(2) a position on said circuit insulator outer end partially encircling said central axis through an angle of greater than 180°;

(3) first and second ends;

(4) an arcuate path of travel of said ball around said lock central axis along said outer surface through approximately 180° from said first end to a point in spaced relation from said second end;

(5) a partly spherical primary stator indentation open at said outer surface at said first end and aligned with said arcuate path of travel of said ball, said indentation being sized to receive and contact a portion of said ball;

(6) a primary terminal stud extending from said inner surface and through said primary stud receiver; and (7) clamp means adapted for clamping an electrical cable to said primary terminal stud in one of said terminal notches;

(g) an electrically conductive secondary stator including:

(1) a substantially planar outer surface and an inner surface adjacent said circuit insulator outer end;

(2) a position on said circuit insulator outer end partially encircling said central axis through an angle of less than 180°;

(3) first and second ends positioned in spaced relation from said primary stator first and second ends respectively;

(4) a partly spherical secondary stator indentation open at said outer surface at said first end and aligned with said primary stator indentation whereby a partly spherical contact indentation is defined, said secondary stator indentation being sized to receive and contact a portion of said ball;

(5) a secondary terminal stud extending from said inner surface and through said secondary stud receiver; and (6) clamping means adapted for clamping an electrical cable to said secondary terminal stud in one of said terminal notches;

(h) said contact indentation being aligned with said tumbler whereby said ball is positioned in contact with said stator inedentations with said tumbler in its closed position; and (i) said contact ball engaging said primary stator outer surface in a rolling engagement along said path of travel of said ball.

2. In combination with a vehicle having a body panel and an electrical system including a battery and a cable connecting the battery to the vehicle, the improvement of a locking switch in the electrical cable, which comprises:

(a) a casing including:

(1) a lock casing section with an interior chamber, a threaded neck extending through said body panel aperture and a lock collar threadably received on said neck whereby said lock casing section is attached to said body panel with said threaded neck extending therethrough; and (2) an insulator casing section including a bore terminating at a closed end and a pair of lead openings communicating with said bore; and (3) a cylinder lock bore extending through said neck and open at said interior chamber (add body panel aperture);

(4) one of said casing sections having a notch and the other of said casing sections having a detent receivable in said notch whereby said casing sections are aligned in a predetermined relationship when fastened together;

(b) a cylinder lock connected to said lock casing section and projecting into said interior chamber thereof, said lock having a tumbler rotatable about a central axis of said lock;

(c) said tumbler having a range of rotational movement of substantially 180° between open and closed positions;

(d) a lock cam connected to said lock within said lock casing section chamber and rotatable about the central axis of said lock, said lock cam including:

(1) a camming body attached to said lock, said camming body including an eccentrically placed bore through said camming body in parallel, spaced relationship relative to the central axis of said lock, said camming body bore having a proximate end and a restricted distal end;

(2) a spring received in said camming body bore;

(3) an insulator plug placed over said proximate end of said bore and engaging said spring; (add electrically insulative)

(4) a plate connected to said tumbler and said camming body over said camming body bore proximate end in engagement with said insulator plug;

(5) a conductor ball received in said camming body bore and engaged by said spring, said conductor ball having a greater diameter than said camming body bore restricted distal end whereby most of said conductor balls within said camming body bore and said conductor ball projects outwardly from said camming body;

(e) a circuit insulator received in said insulator casing section and including:

(1) an outer end located in proximity to said lock cam;

(2) an inner end abutting said insulator casing section closed end;

(3) a pair of terminal notches at said inner end;

(4) primary and secondary stud receivers each extending longitudinally through said circuit insulator between said outer end and a respective notch, each said stud receiver extending in parallel, spaced relation with respect to said cylinder lock central axis;

(5) a flat, shallow cavity at said circuit insulator outer end;

(f) an electrically conductive primary stator including:

(1) a substantially planar outer surface and an inner surface adjacent said circuit insulator outer end;

(2) a position in said circuit insulator cavity partially encircling said central axis through an angle of greater than 180°;

(3) first and second ends;

(4) an arcuate path of travel of said ball around said lock central axis along said outer surface through approximately 180° from said first end to a point in spaced relation from said second end;

(5) a partly spherical primary stator indentation open at said outer surface at said first end and aligned with said arcuate path of travel of said ball, said indentation being sized to receive and contact a portion of said ball;

(6) a primary, integral, threaded terminal stud extending inwardly from said primary stator inner surface through said primary stud receiver; and (7) inner and outer nuts threadably received on said primary stud and clamping said vehicle electrical cable therebetween, said outer nut engaging said circuit insulator;

(g) an electrically conductive secondary stator including:

(1) a substantially planar outer surface and an inner surface adjacent said circuit insulator outer end;

(2) a position in said circuit insulator cavity partially encircling said central axis through an angle of less than 180°;

(3) first and second ends positioned in spaced relation from said primary stator first and second ends respectively;

(4) a partly spherical secondary stator indentation open at said outer surface at said first end and aligned with said primary stator indentation whereby a partly spherical contact indentation is defined, said secondary stator indentation being sized to receive and contact a portion of said ball;

(5) a secondary, integral, threaded terminal stud extending inwardly from said secondary stator inner surface and through said secondary stud receiver; and (6) inner and outer nuts threadably received on said secondary stud and clamping said vehicle electrical cable therebetween, said outer nut engaging said circuit insulator;

(h) said contact indentation being aligned with said tumbler whereby said ball is positioned in contact with said stator indentations with said tumbler in its closed position; and (i) said contact ball engaging said primary stator outer surface in a continuous, biased, rolling engagement along said path of travel of said ball through approximately 180°.

* * * * *